United States Patent [19]

Thomas

[11] 4,036,548

[45] July 19, 1977

[54] GRIP ASSEMBLY FOR ATTACHING AN ELECTRIC CORD TO AN ELECTRIC APPLIANCE, AND THE LIKE

[76] Inventor: Wesley L. Thomas, 109 S. Catalina St., Los Angeles, Calif. 90004

[21] Appl. No.: 712,184

[22] Filed: Aug. 6, 1976

Related U.S. Application Data

[63] Continuation-in-part of Ser. No. 613,080, Sept. 9, 1975, abandoned.

[51] Int. Cl.[2] ..... H01R 13/58

[52] U.S. Cl. ..... 339/103 C; 339/36; 339/47 R; 339/58

[58] Field of Search ..... 339/103 C, 103 B, 101, 339/105, 102 R, 36, 47 R, 48, 58

[56] References Cited

U.S. PATENT DOCUMENTS

| | | | |
|---|---|---|---|
| 2,277,637 | 3/1942 | Eby | 339/103 B X |
| 3,098,115 | 7/1963 | Guarnaschelli | 339/103 C X |

*Primary Examiner*—Roy Lake
*Assistant Examiner*—DeWalden W. Jones
*Attorney, Agent, or Firm*—Keith D. Beecher

[57] ABSTRACT

A grip assembly is provided for locking an electric cord or cable to an electric appliance, such as a telephone receiver, electric drill, lamp base, or the like. The grip assembly in one embodiment comprises a threaded split bushing which is threaded into the appliance and which surrounds a molded sleeve on the electric cord or cable. The bore of the nut has a surface complementing the outer shape of the sleeve, thereby assuring that the cord will not pull out of the appliance and thus exert a strain on the electrical connections between the wires of the cord and the internal electric elements within the appliance. In a second embodiment the threaded split bushing is supported on the base of an appliance by a nut. The electric cord extends through the sleeve, and when the nut is tightened, the sleeve closes, as a vise, around the cord in a clamping engagement therewith.

7 Claims, 8 Drawing Figures

FIG. 5
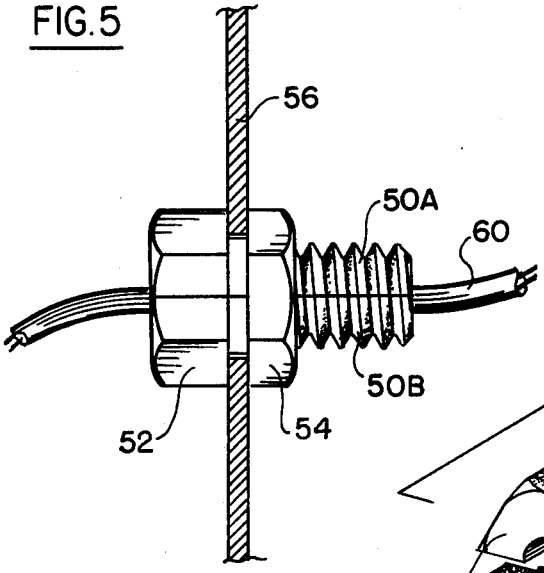
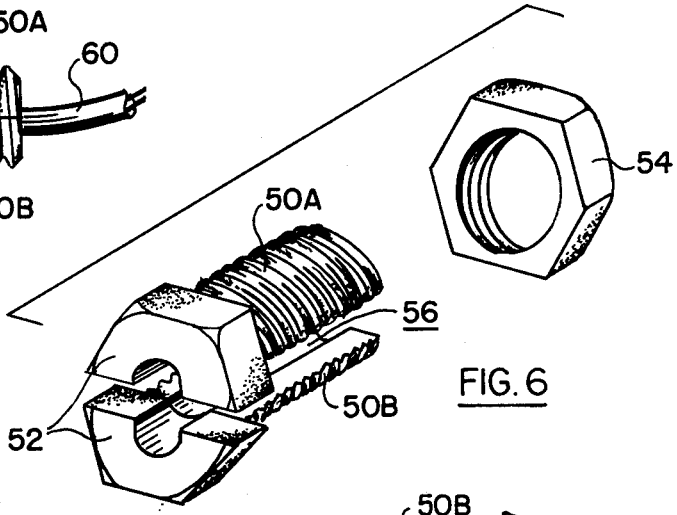
FIG. 6
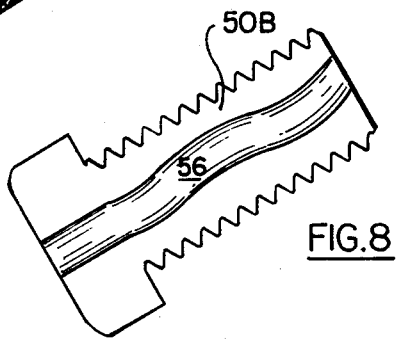
FIG. 8
FIG. 7
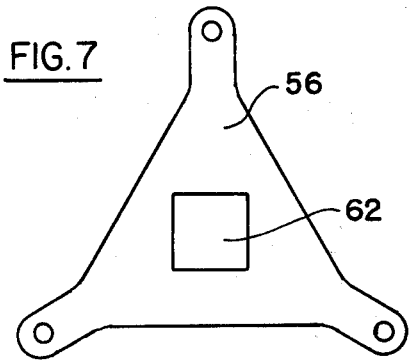
FIG. 4
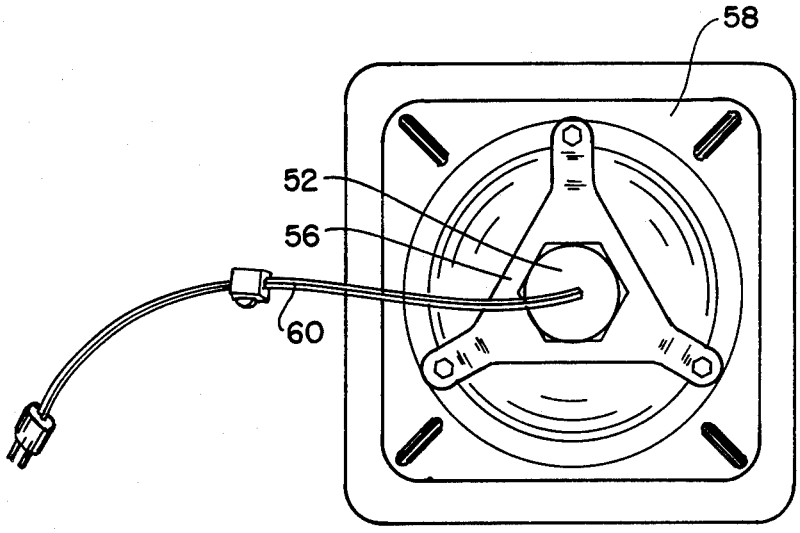

GRIP ASSEMBLY FOR ATTACHING AN ELECTRIC CORD TO AN ELECTRIC APPLIANCE, AND THE LIKE

This application is a continuation-in-part of copending application Ser. No. 613,080, filed Sept. 9, 1975, now abandoned.

BACKGROUND OF THE INVENTION

In mounting an electric cord to an electric appliance, or the like, it is most important to provide means for attaching the cord to the appliance in such a way as to relieve the strain on the binding posts, solder joints, and other electric connections within the appliance.

It has been the practice in the past to provide clamps, or other devices, which are mounted on the appliance, and which have screws that are tightened to clamp the device around the electric cord. However, such clamps have proven to be generally ineffective in providing an adequate grip on the cord, so as to assure that the electrical connections between the wires in the cord and the internal electrical elements within the appliance will be free of strain even under conditions of rough handling and excessive stresses on the cord.

The grip assembly of the present invention provides a positive secure lock between the appliance and the electric cord, assuring that any stress exerted between the cord and the appliance will be withstood by the assembly itself, with no strain whatever being exerted on the electric connections within the appliance.

One embodiment of the grip assembly of the invention will be described herein in conjunction with a telephone receiver and its associated electric cord, and the assembly serves to protect the internal electrical connections of the receiver even when the receiver and cord are subjected to excessive stresses and rough usage. In a second embodiment, the grip assembly will be described in conjunction with the base of a lamp.

It will become evident as the description proceeds, however, that the grip assembly of the invention has wide utility in attaching electric cords to appliances, and the like, in such a manner that the internal electrical connections are free from strain under all external stresses that may be exerted on the cord.

BRIEF DESCRIPTION OF THE DRAWINGS

FIG. 4 is a bottom view of the lamp showing a second embodiment of the grip assembly of the invention mounted on the base of the lamp;

FIG. 5 is a section taken along the line 5—5 of FIG. 4;

FIG. 6 is an exploded perspective view of the second embodiment;

FIG. 7 is a plan view of a spider bracket forming a portion of the base of the lamp of FIG. 1; and FIG. 8 is a plan view of one of the sections of the second embodiment.

DETAILED DESCRIPTION OF THE ILLUSTRATED EMBODIMENTS

Figure 1:
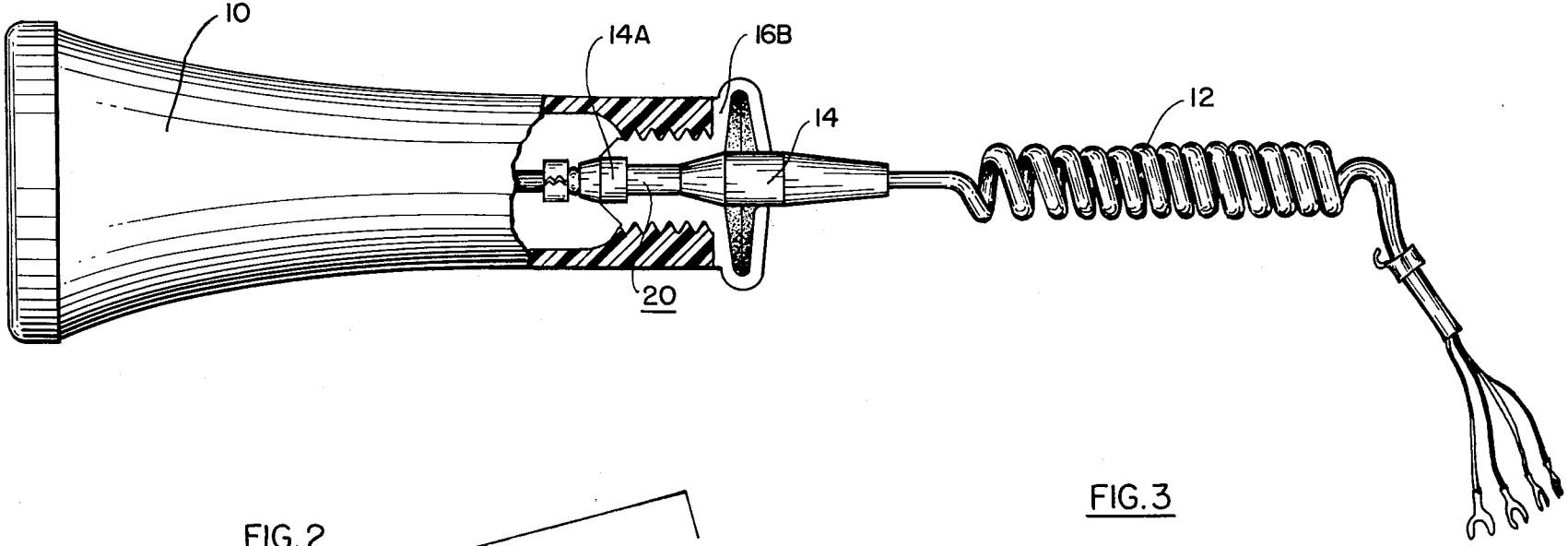
FIG. 1 is a side view, partly in section, of a telephone receiver and an electric cord, attached to one another by the grip assembly of the invention, in one of its embodiments.
Figure 3:
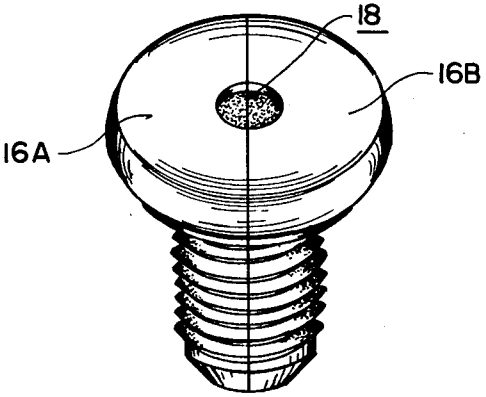
FIG. 3 is a further perspective view of the split bushing, showing the segments of FIG. 2 in position adjacent to one another.
Figure 2:
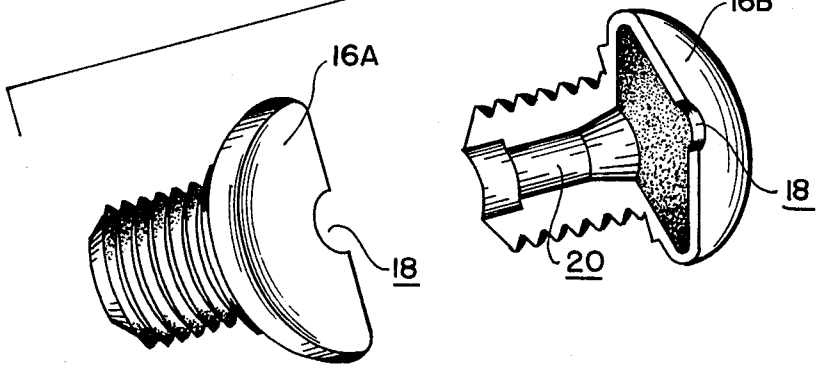
FIG. 2 is a perspective representation of two segments which make up a threaded split bushing used in the grip assembly of the invention, the segments being shown separated from one another.

In the first illustrated embodiment of FIGS. 1-3, a telephone receiver 10 is attached to a usual electric cord 12 by means of the assembly of the invention. The assembly includes a sleeve 14 which is molded to the external covering of the cord 10 and which has peripheral shoulders, such as shoulder 14A, formed on its outer surface, both the sleeve and the external covering of the cord being formed of appropriate plastic material.

A split bushing is formed of two segments 16A, 16B which are placed adjacent to one another around the sleeve 14, and in a position as shown in FIG. 3. The external surface of the bushing is threaded so that the bushing may be screwed into the end of the receiver 10, as shown in FIG. 1. The two segments 16A, 16B form the split bushing and define an inner bore 20 which receives the sleeve 14, the end of which projects out through a hole 18. The shape of the inner bore surface complements the outer shape of the sleeve, so that a positive lock between the split bushing and the sleeve 14 is achieved.

Regardless of the stress exerted on the cord 12, the entire strain is taken by the engagement of the shoulder 14A and other portions of the surface of sleeve 14 with the inner bore surface of the split bushing 16A, 16B, so that no stress can ever be exerted on the internal electrical connections between the wires of the cord 12 and the internal electrical components of the receiver.

In the embodiment of FIGS. 4, 5, 6 and 7, the grip assembly is formed of a split bushing 50A, 50B which is tapered from the left to the right in FIG. 6. The split bushing has a hexagonal head 52, and it is held in place by a nut 54.

The split bushing is illustrated as mounted on a spider 56 which forms part of the base 58 of a lamp. An electric cord 60 extends through a longitudinal channel 56 in the split bushing (FIG. 8) into the interior of the lamp. As shown in FIG. 8, the channel 56 has a tortuous shape to prevent the cord 60 from sliding in the bushing. The split bushing has a rectangular neck adjacent to the head 52, which is received in a rectangular opening 62 in the spider 56, so that there will be no tendency for the bushing to turn in the spider.

As the nut 54 is threaded to the bushing, and as it is tightened against the head 52 to the position of FIG. 5, the two parts of the split bushing are forced together to clamp the cord 60 between them tightly and securely.

The invention provides, therefore, a simple and improved grip assembly for attaching a cord, such as a cord 12 (FIG. 1) to an electric appliance, such as the telephone receiver 10, or a cord, such as a cord 60 (FIG. 4) to the base 58 of a lamp. As described, the assembly is such that, regardless of stresses exerted by the cord on the receiver 10 or base 58, or vice versa, all the strain is taken by the sleeve, and no strain is exerted on the internal electrical connections.

It will be appreciated that although particular embodiments of the invention have been shown and described, modifications may be made. It is intended in the claims to cover the modifications which come within the spirit and scope of the invention.

What is claimed is:

1. A grip assembly for use with an electric appliance, and the like, for attaching an electric cord to the appliance, said grip assembly including: a sleeve affixed to the end of the cord and having an external peripheral shoulder formed thereon; and a plurality of arcuate-shaped members positioned adjacent to one another to surround said sleeve and having external threads thereon to enable the arcuate-shaped members to be threaded into the appliance to form a split bushing surrounding the sleeve for receiving the sleeve and having an inner bore surface engaging the periphery shoulder thereon.

2. The grip assembly defined in claim 1, in which the sleeve is bonded to the cord.

3. The grip assembly defined in claim 1, in which the bushing is formed of a pair of semi-circular members positioned adjacent to one another to surround the sleeve and having external threads thereon to enable the semi-circular members to be threaded into the appliance, said threaded members defining a central bore for receiving the sleeve and having a shape complementing the outer surface of the sleeve.

4. A grip assembly for use with an electric appliance, and the like, said appliance having a bracket with a hole therein for receiving an electric cord, and said grip assembly including: a split bushing formed of a plurality of arcuate-shaped members received in the hole in the bracket and positioned adjacent to one another to surround the electric cord as it passes through the hole, said split bushing having external threads thereon to permit the bushing to be mounted in the hole of the bracket and to exert a clamping action against the cord, and which includes a nut threaded into the split bushing to mount the bushing in the hole of the bracket.

5. The grip assembly defined in claim 4, in which the split bushing has a head engaging one side of the bracket, and a tapered configuration extending inwardly from the head, so that the nut causes the split bushing to exert a clamping action on the cord as the nut is tightened on the bushing.

6. The grip assembly defined in claim 5, in which said hole has a non-circular shape, and in which the neck of the bushing adjacent to said head has a mating shape, so at to enable the bushing to be received in the hole without turning.

7. The grip assembly defined in claim 5, in which the split bushing has a tortuous shaped channel extending therethrough to receive the electric cord in a non-slipping relationship therewith.

* * * * *